US007473339B2

(12) United States Patent
D'Ambra et al.

(10) Patent No.: US 7,473,339 B2
(45) Date of Patent: Jan. 6, 2009

(54) SLIM CELL PLATFORM PLUMBING

(75) Inventors: Allen L. D'Ambra, Burlinggame, CA (US); Arulkumar Shanmugasundram, Sunnyvale, CA (US); Michael X. Yang, Palo Alto, CA (US); Yevgeniy (Eugene) Rabinovich, Fremont, CA (US); Dmitry Lubomirsky, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1013 days.

(21) Appl. No.: 10/826,489

(22) Filed: Apr. 16, 2004

(65) Prior Publication Data

US 2004/0206623 A1 Oct. 21, 2004

Related U.S. Application Data

(60) Provisional application No. 60/463,956, filed on Apr. 18, 2003.

(51) Int. Cl.
*C25D 17/00* (2006.01)
*C25D 21/14* (2006.01)
*C25D 7/12* (2006.01)

(52) U.S. Cl. ..... 204/240; 204/257; 204/264

(58) Field of Classification Search ..... None
See application file for complete search history.

(56) References Cited

U.S. PATENT DOCUMENTS 2,733,198 A 1/1956 Nobel et al.
2,842,488 A 7/1958 Strauss et al.
2,882,209 A 4/1959 Brown et al.
2,972,572 A 2/1961 Cope, Jr. et al.
4,009,087 A 2/1977 Kardos et al.
4,304,841 A 12/1981 Horn et al.
4,466,864 A 8/1984 Bacon et al.
4,555,315 A 11/1985 Barbieri et al.
5,168,886 A 12/1992 Thompson et al.
5,230,743 A 7/1993 Thompson et al.
5,252,196 A 10/1993 Sonnenberg et al.
5,544,421 A 8/1996 Thompson et al.
5,573,023 A 11/1996 Thompson et al.
5,660,517 A 8/1997 Thompson et al.
5,664,337 A 9/1997 Davis et al.
5,678,320 A 10/1997 Thompson et al.
5,695,720 A * 12/1997 Wade et al. ..... 422/82
5,784,802 A 7/1998 Thompson et al.
5,788,454 A 8/1998 Thompson et al.
5,972,192 A 10/1999 Dubin et al.

(Continued)

OTHER PUBLICATIONS

U.S. Appl. No. 09/872,340 as filed, incorported by reference in its entirety into Mayer et al (US 2002/0074238), May 2001.*

*Primary Examiner*—Harry D Wilkins, III
(74) *Attorney, Agent, or Firm*—Patterson & Sheridan

(57) ABSTRACT

Embodiments of the invention generally provide a fluid delivery system for an electrochemical plating platform. The fluid delivery system is configured to supply multiple chemistries to multiple plating cells with minimal bubble formation in the fluid delivery system. The system includes a solution mixing system, a fluid distribution manifold in communication with the solution mixing system, a plurality of fluid conduits in fluid communication with the fluid distribution manifold, and a plurality of fluid tanks, each of the plurality of fluid tanks being in fluid communication with at least one of the plurality of fluid conduits.

9 Claims, 7 Drawing Sheets

U.S. PATENT DOCUMENTS 5,996,241 A 12/1999 Thompson et al.
6,014,817 A 1/2000 Thompson et al.
6,074,544 A 6/2000 Reid et al.
6,091,498 A 7/2000 Hanson et al.
6,110,346 A 8/2000 Reid et al.
6,143,126 A 11/2000 Stevens
6,162,344 A 12/2000 Reid et al.
6,197,181 B1 * 3/2001 Chen ..... 205/123
6,203,582 B1 3/2001 Berner et al.
6,214,193 B1 4/2001 Reid et al.
6,244,737 B1 6/2001 Rittner et al.
6,273,110 B1 8/2001 Davis et al.
6,290,833 B1 9/2001 Chen
6,319,387 B1 11/2001 Krishnamoorthy et al.
6,319,553 B1 11/2001 McInerney et al.
6,326,297 B1 12/2001 Vijayendran
6,334,937 B1 1/2002 Batz, Jr. et al.
6,368,966 B1 4/2002 Krishnamoorthy et al.
6,376,374 B1 4/2002 Stevens
6,408,535 B1 6/2002 Thomas
6,428,673 B1 8/2002 Ritzdorf et al.
6,471,845 B1 * 10/2002 Dukovic et al. ..... 205/81
6,527,920 B1 * 3/2003 Mayer et al. ..... 204/237
7,223,323 B2 * 5/2007 Yang et al. ..... 204/242
2001/0015321 A1 * 8/2001 Reid et al. ..... 205/103
2001/0052465 A1 * 12/2001 Dordi et al. ..... 205/95
2002/0074238 A1 * 6/2002 Mayer et al. ..... 205/660
2002/0179544 A1 * 12/2002 Johnson et al. ..... 210/806
2004/0016637 A1 * 1/2004 Yang et al. ..... 204/242
2004/0118694 A1 * 6/2004 Yang et al. ..... 205/157
2004/0154926 A1 * 8/2004 Sun et al. ..... 205/118
2005/0077182 A1 * 4/2005 Balisky et al. ..... 205/82

* cited by examiner

SLIM CELL PLATFORM PLUMBING

CROSS-REFERENCE TO RELATED APPLICATIONS

This application claims benefit of U.S. provisional patent application Ser. No. 60/463,956, filed Apr. 18, 2003, which is herein incorporated by reference.

BACKGROUND OF THE INVENTION

1. Field of the Invention

Embodiments of the invention generally relate to a fluid delivery system for a multichemistry electrochemical plating system.

2. Description of the Related Art

Metallization of sub-quarter micron sized features is a foundational technology for present and future generations of integrated circuit manufacturing processes. More particularly, in devices such as ultra large scale integration-type devices, i.e., devices having integrated circuits with more than a million logic gates, the multilevel interconnects that lie at the heart of these devices are generally formed by filling high aspect ratio, i.e., greater than about 4:1, interconnect features with a conductive material, such as copper. Conventionally, deposition techniques such as chemical vapor deposition (CVD) and physical vapor deposition (PVD) have been used to fill these interconnect features. However, as the interconnect sizes decrease and aspect ratios increase, void-free interconnect feature fill via conventional metallization techniques becomes increasingly difficult. Therefore, plating techniques, i.e., electrochemical plating (ECP) and electroless plating, have emerged as promising processes for void free filling of sub-quarter micron sized high aspect ratio interconnect features in integrated circuit manufacturing processes.

In an ECP process, for example, sub-quarter micron sized high aspect ratio features formed into the surface of a substrate (or a layer deposited thereon) may be efficiently filled with a conductive material. ECP plating processes are generally two stage processes, wherein a seed layer is first formed over the surface features of the substrate (generally through PVD, CVD, or other deposition process in a separate tool), and then the surface features of the substrate are exposed to an electrolyte solution (in the ECP tool), while an electrical bias is applied between the seed layer and a copper anode positioned within the electrolyte solution. The electrolyte solution generally contains ions to be plated onto the surface of the substrate, and therefore, the application of the electrical bias causes these ions to be plated onto the biased seed layer, thus depositing a layer of the ions on the substrate surface that may fill the features.

Once the plating process is completed, the substrate is generally transferred to at least one of a substrate rinsing cell or a bevel edge clean cell. Bevel edge clean cells are generally configured to dispense an etchant onto the perimeter or bevel of the substrate to remove unwanted metal plated thereon. The substrate rinse cells, often called spin rinse dry cells, generally operate to rinse the surface of the substrate (both front and back) with a rinsing solution to remove any contaminants therefrom. Further the rinse cells are often configured to spin the substrate at a high rate of speed in order to spin off any remaining fluid droplets adhering to the substrate surface. Once the remaining fluid droplets are spun off, the substrate is generally clean and dry, and therefore, ready for transfer from the ECP tool.

Conventional plating platforms or systems may include one or more plating cells, a bevel clean cell, and an SRD cell. Each of the plating cells on a conventional plating system or platform is in communication with a common electrolyte source, i.e., a common electrolyte tank, and therefore, each plating cell utilizes the electrolyte provided by the common tank. This configuration presents challenges to controlling plating parameters in different plating processes that may be conducted in the respective plating cells, as the single chemistry provided may, for example, exhibit above average performance characteristics when filling a feature on a substrate, but exhibit below average performance characteristics when bulk or overfilling a substrate. As such, there is a need for an electrochemical plating system configured to supply multiple chemistries to multiple plating cells on a single plating platform.

Embodiments of the invention generally provide a fluid delivery system for an electrochemical plating system, wherein the fluid delivery system is configured to provide multiple chemistries to multiple plating cells on a single plating system or platform.

SUMMARY OF THE INVENTION

Embodiments of the invention generally provide a fluid delivery system for a multichemistry electrochemical plating platform. The fluid delivery system is configured to supply multiple chemistries to multiple plating cells on a single system platform with minimal bubble formation in thy fluid delivery system. The system includes a solution mixing system, a fluid distribution manifold in communication with the solution mixing system, a plurality of fluid conduits in fluid communication with the fluid distribution manifold, and a plurality of fluid tanks, each of the plurality of fluid tanks being in fluid communication with at least one of the plurality of fluid conduits and at least one plating cell. The conduits being configured to purge or drain after a fluid solution has been supplied to the fluid tanks via a purge valve positioned adjacent the respective tanks in the supply conduit.

Embodiments of the invention may further provide a plating solution mixing and delivery system for an electrochemical plating platform. The plating solution mixing and delivery system includes a fluid mixing apparatus, having a fluid metering pump having a plurality inputs and at least one output, a base solution container in fluid communication with one of the plurality of inputs, a plurality of additive containers, each of the plurality of additive containers being in fluid communication with at least one of the inputs, and a controller in communication with the fluid metering pump, the controller being configured to operate the metering pump such that the base solution and fluid from the plurality of additive containers is mixed in a predetermined ratio and dispensed from one of the at least one outputs. The system further includes a fluid dispensing manifold in fluid communication with the fluid mixing apparatus, an anolyte conduit in fluid communication with the manifold, a catholyte conduit in fluid communication with the mixing manifold, at least one anolyte tank in fluid communication with the first conduit, and at least one catholyte tank in fluid communication with the second conduit.

Embodiments of the invention may further provide a plating solution mixing and delivery system for a multi-chemistry electrochemical plating system. The solution mixing and delivery system includes a plating solution mixing assembly positioned onboard the multi-chemistry electrochemical plating system, at least one catholyte solution tank and at least one anolyte solution tank, each of the anolyte solution tank and the catholyte solution tank being in fluid communication with the plating solution mixing assembly, a fluid bubble baffle assembly positioned inside the catholyte solution tank, and a supply line purge valve positioned adjacent each of the catholyte solution tank and the anolyte solution tank in fluid communication with fluid supply return line for the respective tanks, the supply line purge valve being configured to drain fluid from the-supply return line after a fluid solution has been delivered to the tank.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the invention generally provide a multi-chemistry electrochemical plating system configured to plate conductive materials onto semiconductor substrates. The plating system generally includes a substrate loading area in communication with a substrate processing platform. The loading area is generally configured to receive substrate containing cassettes and transfer substrates received from the cassettes into the plating system for processing. The loading area generally includes a robot configured to transfer substrates to and from the cassettes and to the processing platform or a substrate annealing chamber positioned in communication with the loading area. The processing platform generally includes at least one substrate transfer robot and a plurality of substrate processing cells, i.e., ECP cells, bevel clean cells, spin rinse dry cells, substrate cleaning cells, and electroless plating cells.

Figure 1:
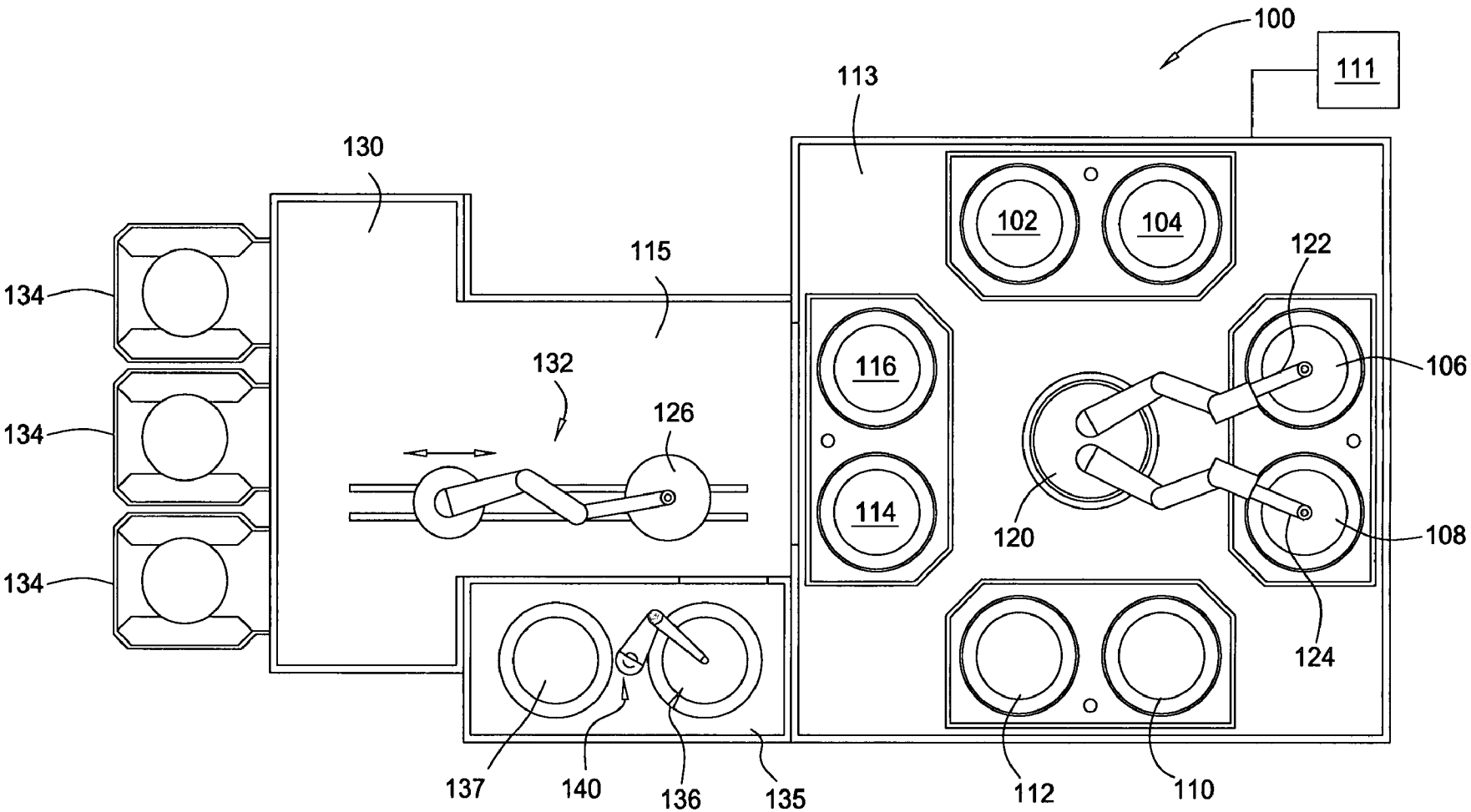
FIG. 1 is a top plan view of one embodiment of an electrochemical plating system of the invention.

FIG. 1 illustrates a top plan view of an ECP system 100 of the invention. ECP system 100 includes a factory interface (FI) 130, which is also generally termed a substrate loading station. Factory interface 130 includes a plurality of substrate loading stations configured to interface with substrate containing cassettes 134. A robot 132 is positioned in factory interface 130 and is configured to access substrates contained in the cassettes 134. Further, robot 132 also extends into a link tunnel 115 that connects factory interface 130 to processing mainframe or platform 113. The position of robot 132 allows the robot to access substrate cassettes 134 to retrieve substrates therefrom and then deliver the substrates to one of the processing cells 114, 116 positioned on the mainframe 113, or alternatively, to the annealing station 135. Similarly, robot 132 may be used to retrieve substrates from the processing cells 114, 116 or the annealing chamber 135 after a substrate processing sequence is complete. In this situation robot 132 may deliver the substrate back to one of the cassettes 134 for removal from system 100.

The anneal chamber 135 generally includes a two position annealing chamber, wherein a cooling plate/position 136 and a heating plate/position 137 are positioned adjacently with a substrate transfer robot 140 positioned proximate thereto, e.g., between the two stations. The robot 140 is generally configured to move substrates between the respective heating 137 and cooling plates 136. Further, although the anneal chamber 135 is illustrated as being positioned such that it is accessed from the link tunnel 115, embodiments of the invention are not limited to any particular configuration or placement. As such, the anneal chamber may be positioned in communication with the mainframe 113.

As mentioned above, ECP system 100 also includes a processing mainframe 113 having a substrate transfer robot 120 centrally positioned thereon. Robot 120 generally includes one or more arms/blades 122, 124 configured to support and transfer substrates thereon. Additionally, the robot 120 and the accompanying blades 122, 124 are generally configured to extend, rotate, and vertically move so that the robot 120 may insert and remove substrates to and from a plurality of processing locations 102, 104, 106, 108, 110, 112, 114, 116 positioned on the mainframe 113. Similarly, factory interface robot 132 also includes the ability to rotate, extend, and vertically move its substrate support blade, while also allowing for linear travel along the robot track that extends from the factory interface 130 to the mainframe 113. Generally, process locations 102, 104, 106, 108, 110, 112, 114, 116 may be any number of processing cells utilized in an electrochemical plating platform. More particularly, the process locations may be configured as electrochemical plating cells, rinsing cells, bevel clean cells, spin rinse dry cells, substrate surface cleaning cells, electroless plating cells, metrology inspection stations, and/or other processing cells that may be beneficially used in conjunction with a plating platform. Each of the respective processing cells and robots are generally in communication with a process controller 111, which may be a microprocessor-based control system. configured to receive inputs from both a user and/or various sensors positioned on the system 100 and appropriately control the operation of system 100 in accordance with the inputs.

In the exemplary plating system illustrated in FIG. 1, the processing locations may be configured as follows. Processing locations 114 and 116 may be configured as an interface between the wet processing stations on the mainframe 113 and the dry processing regions in the link tunnel 115, annealing chamber 135, and the factory interface 130. The processing cells located at the interface locations may be spin rinse dry cells and/or substrate cleaning cells. More particularly, each of locations 114 and 116 may include both a spin rinse dry cell and a substrate cleaning cell in a stacked configuration. Locations 102, 104, 110, and 112 may be configured as plating cells, either electrochemical plating cells or electroless plating cells, for example. Locations 106, 108 may be configured as substrate bevel cleaning cells. Additional configurations and implementations of an electrochemical processing system are illustrated in commonly assigned U.S. patent application Ser. No. 10/435,121 filed on Dec. 19, 2002 entitled "Multi-Chemistry Electrochemical Processing System", which is incorporated herein by reference in its entirety.

Figure 2:
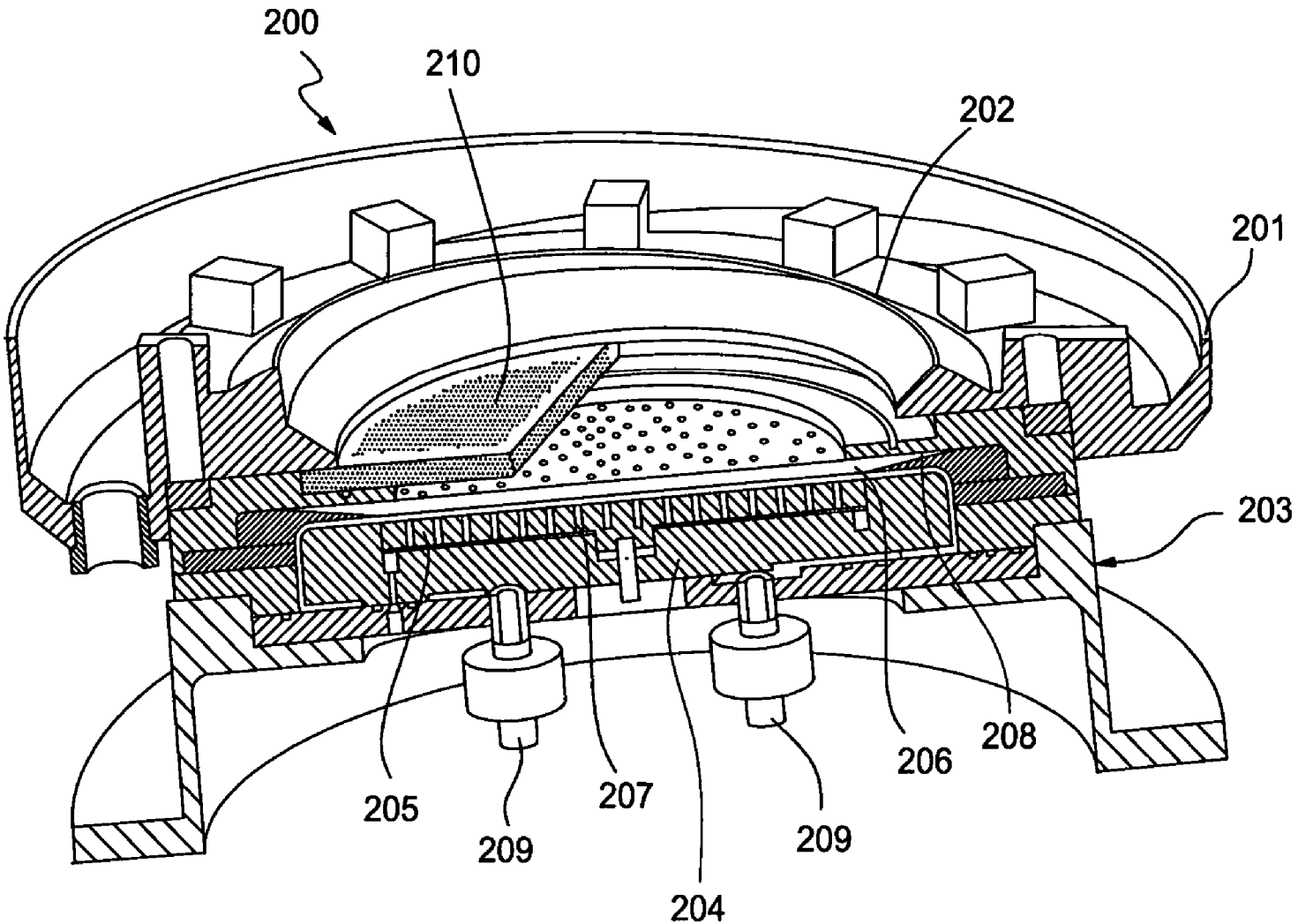
FIG. 2 illustrates an exemplary embodiment of a plating cell used in the electrochemical plating cell of the invention.

FIG. 2 illustrates a partial perspective and sectional view of an exemplary plating cell 200 that may be implemented in processing locations 102, 104, 110, and 112. The electrochemical plating cell 200 generally includes an outer basin 201 and an inner basin 202 positioned within outer basin 201. Inner basin 202 is generally configured to contain a plating solution that is used to plate a metal, e.g., copper, onto a substrate during an electrochemical plating process. During the plating process, the plating solution is generally continuously supplied to inner basin 202 (at about 1 gallon per minute for a 10 liter plating cell, for example), and therefore, the plating solution continually overflows the uppermost point (generally termed a "weir") of inner basin 202 and is collected by outer basin 201 and drained therefrom for chemical management and recirculation. Plating cell 200 is generally positioned at a tilt angle, ie., the frame portion 203 of plating cell 200 is generally elevated on one side such that the components of plating cell 200 are tilted between about 3° and about 30°, or generally between about 4° and about 10° for optimal results. The frame member 203 of plating cell 200 supports an annular base member on an upper portion thereof. Since frame member 203 is elevated on one side, the upper surface of base member 204 is generally tilted from the horizontal at an angle that corresponds to the angle of frame member 203 relative to a horizontal position. Base member 204 includes an annular or disk shaped recess formed into a central portion thereof, the annular recess being configured to receive a disk shaped anode member 205. Base member 204 further includes a plurality of fluid inlets/drains 209 extending from a lower surface thereof. Each of the fluid inlets/drains 209 are generally configured to individually supply or drain a fluid to or from either the anode compartment or the cathode compartment of plating cell 200. Anode member 205 generally includes a plurality of slots 207 formed therethrough, wherein the slots 207 are generally positioned in parallel orientation with each other across the surface of the anode 205. The parallel orientation allows for dense fluids generated at the anode surface to flow downwardly across the anode surface and into one of the slots 207. Plating cell 200 further includes a membrane support assembly 206. Membrane support assembly 206 is generally secured at an outer periphery thereof to base member 204, and includes an interior region configured to allow fluids to pass therethrough. A membrane 208 is stretched across the support 206 and operates to fluidly separate a catholyte chamber and anolyte chamber portions of the plating cell. The membrane support assembly may include an o-ring type seal positioned near a perimeter of the membrane, wherein the seal is configured to prevent fluids from traveling from one side of the membrane secured on the membrane support 206 to the other side of the membrane. A diffusion plate 210, which is generally a porous ceramic disk member is configured to generate a substantially laminar flow or even flow of fluid in the direction of the substrate being plated, is positioned in the cell between membrane 208 and the substrate being plated. The exemplary plating cell is further illustrated in commonly assigned U.S. patent application Ser. No. 10/268,284, which was filed on Oct. 9, 2002 under the title "Electrochemical Processing Cell", claiming priority to U.S. provisional application Ser. No. 60/398,345, which was filed on Jul. 24, 2002, both of which are incorporated herein by reference in their entireties.

Figure 3:
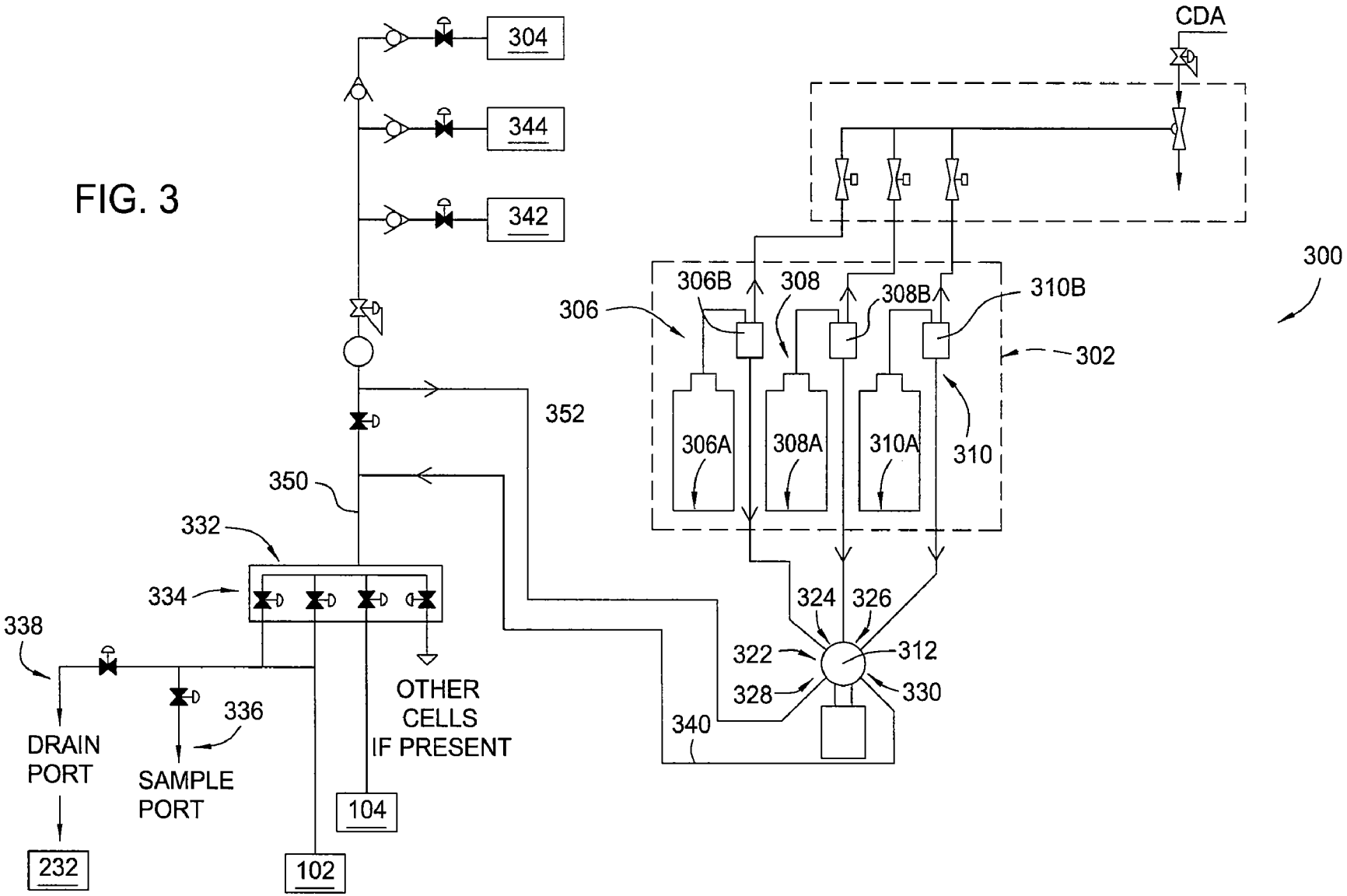
FIG. 3 illustrates an exemplary fluid delivery system of the invention.

FIG. 3 is a schematic diagram of one embodiment of a plating solution delivery system 300. The plating solution delivery system 300 is generally configured to supply a plating solution or anolyte solution to each processing location on system 100 that requires one of these solutions. More particularly, the plating solution delivery system is further configured to supply a different plating solution or chemistry to each of the processing locations. For example, the delivery system may provide a first plating solution or chemistry to processing locations 110, 112, while providing a different plating solution or chemistry to processing locations 102, 104. The individual plating solutions are generally isolated for use with a single plating cell, and therefore, there are no cross contamination issues with the different chemistries. However, embodiments of the invention contemplate that more than one cell may share a common chemistry that is different from another chemistry that is supplied to another plating cell on the system. These features are advantageous, as the ability to provide multiple chemistries to a single processing platform allows for multiple chemistry plating processes on a single platform.

In another embodiment of the invention, a first plating solution and a separate and different second plating solution can be provided sequentially to a single plating cell. Typically, providing two separate chemistries to a single plating cell requires the plating cell to be drained and/or purged between the respective chemistries, however, a mixed ratio of less than about 10 percent first plating solution to the second plating solution should not be detrimental to film properties.

Plating solution delivery system 300 typically includes a plurality of additive sources 302 and at least one electrolyte source 304 that are fluidly coupled to each of the processing cells of system 100 via a manifold 332. Typically, the additive sources 302 include an accelerator source 306, a leveler source 308, and a suppressor source 310. The accelerator source 306 is adapted to provide an accelerator material that typically adsorbs on the surface of the substrate and locally accelerates the electrical current at a given voltage where they adsorb. Examples of accelerators include sulfide-based molecules. The leveler source 308 is adapted to provide a leveler material that operates to facilitate planar plating. Examples of levelers are nitrogen containing long chain polymers. The suppressor source 310 is adapted to provide suppressor materials that tend to reduce electrical current at the sites where they adsorb (typically the upper edges/corners of high aspect ratio features). Therefore, suppressors slow the plating process at those locations, thereby reducing premature closure of the feature before the feature is completely filled and minimizing detrimental void formation. Examples of suppressors include polymers of polyethylene glycol, mixtures of ethylene oxides and propylene oxides, or copolymers of ethylene oxides and propylene oxides.

In order to prevent situations where an additive source runs out and to minimize additive waste during bulk container replacement, each of the additive sources 302 generally includes a bulk or larger storage container 306A, 308A, 310A coupled to a smaller buffer container 306B, 308B, 310B. The buffer container 306B, 308B, 310B is generally filled from the bulk storage container 306A, 308A, 310A, and therefore, the bulk container 306A, 308A, 310A may be removed for replacement without affecting the operation of the fluid delivery system, as the associated buffer container 306B, 308B, 310B may supply the particular additive to the system while the bulk container 306B, 308B, 310B is being replaced. The volume of the buffer container 306B, 308B, 310B is typically much less than the volume of the bulk container 306A, 308A, 310A. It is sized to contain enough additive for 10 to 12 hours of uninterrupted operation. This provides sufficient time for operators to replace the bulk container 306A, 308A, 310A when the bulk container 306A, 308A, 310A is empty. If the buffer container 306B, 308B, 310B was not present and uninterrupted operation was still desired, the bulk containers 306A, 308A, 310A would have to be replaced prior to being empty, thus resulting in significant additive waste.

In the embodiment depicted in FIG. 3, a dosing pump 312 is coupled between the plurality of additive sources 302 and the plurality of processing cells. The dosing pump 312 generally includes at least a first through fourth inlet ports 322, 324, 326, 328. As an example, the first inlet port 322 is generally coupled to the accelerators source 306, the second inlet port 324 is generally coupled to the leveler source 308, the third inlet port 326 is generally coupled to the suppressor source 310, and the fourth inlet port 328 is generally coupled to the electrolyte source 304. An output 330 of the dosing pump 312 is generally coupled to the processing cells via manifold 332 by an output line 340 wherein mixing of the sequentially supplied additives (i.e., at least one or more accelerators, levelers and/or suppressors) may be combined with electrolyte provided to the manifold 332 through a first delivery line 350 from the electrolyte source 304, to form the first or second plating solutions as desired. The dosing pump 312 may be any metering device(s) adapted to provide measured amounts of selective additives to the process cells 102, 104. The dosing pump 312 may be a rotary metering valve, a solenoid metering pump, a diaphragm pump, a syringe, a peristaltic pump, or other positive displacement pumps used singularly or coupled to a flow sensor. In addition, the additives could be pressurized and coupled to a flow sensor, coupled to a liquid mass flow controller, or metered by weight utilizing load cell measurement of the pressurized dispense vessel or other fluid metering devices acceptable for flowing electrochemical plating solutions to a plating cell. In one embodiment, the dosing pump includes a rotating and reciprocating ceramic piston that drives 0.32 ml per cycle of a predetermined additive.

In another embodiment of the invention the fluid delivery system may be configured to provide a second completely different plating solution and associated additives. For example, in this embodiment a different base electrolyte solution (similar to the solution contained in container 304) may be implemented to provide the processing system 100 with the ability, for example, to use plating solutions from two separate manufacturers. Further, an additional set of additive containers may also be implemented to correspond with the second base plating solution. Therefore, this embodiment of the invention allows for a first chemistry (a chemistry provided by a first manufacturer) to be provided to one or more plating cells of system 100, while a second chemistry (a chemistry provided by a second manufacturer) is provided to one or more plating cells of system 100. Each of the respective chemistries will generally have their own associated additives, however, cross dosing of the chemistries from a single additive source or sources is not beyond the scope of the invention.

In order to implement the fluid delivery system capable of providing two separate chemistries from separate base electrolytes, a duplicate of the fluid delivery system illustrated in FIG. 3 is connected to the processing system. More particularly, the fluid delivery system illustrated in FIG. 3 is generally modified to include a second set of additive containers 302, a second pump assembly 312, and a second manifold 332 (shared manifolds are possible). Additionally, separate sources for virgin makeup solution/base electrolyte 304 are also provided. The additional hardware is set up in the same configuration as the hardware illustrated in FIG. 3, however, the second fluid delivery system is generally in parallel with the illustrated or first fluid delivery system. Thus, with this configuration implemented, either base chemistry with any combination of the available additives may be provided to any one or more of the processing cells of system 100.

The manifold 332 is typically configured to interface with a bank of valves 334. Each valve of the valve bank 334 may be selectively opened or closed to direct fluid from the manifold 332 to one of the process cells of the plating system 100. The manifold 332 and valve bank 334 may optionally be configured to support selective fluid delivery to additional number of process cells. In the embodiment depicted in FIG. 3, the manifold 332 and valve bank 334 include a sample port 336 that allows different combinations of chemistries or component thereof utilized in the system 100 to be sampled without interrupting processing.

In some embodiments, it may be desirable to purge the dosing pump 312, output line 340 and/or manifold 332. To facilitate such purging, the plating solution delivery system 300 is configured to supply at least one of a cleaning and/or purging fluid, which may be deionized water or a purge gas, for example. In the embodiment depicted in FIG. 3, the plating solution delivery system 300 includes a deionized water source 342 and a non-reactive gas source 344 coupled to the first delivery line 350. The non-reactive gas source 344 may supply a non-reactive gas, such as an inert gas, air, or nitrogen through the first delivery line 350 to flush out the manifold 332. Deionized water may be provided from the deionized water source 342 to flush out the manifold 332 in addition to,or in place of the non-reactive gas. Electrolyte from the electrolyte sources 304 may also be utilized as a purge medium.

A second delivery line 352 is teed between the first gas delivery line 350 and the dosing pump 312. A purge fluid includes at least one of the electrolyte, deionized water or non-reactive gas from their respective sources 304, 342, 344 may be diverted from the first delivery line 350 through the second gas delivery line 352 to the dosing pump 312. The purge fluid is driven through the dosing pump 312 and out the output line 340 to the manifold 332. The valve bank 334 typically directs the purge fluid out a drain port 338 to the reclamation system 232. The various other valves, regulators and other flow control devices have not been described and/or shown for the sake of brevity.

In one embodiment of the invention, a first chemistry may be provided to the manifold 332 that promotes feature filling of copper on a semiconductor substrate. The first chemistry may include between about 30 and about 65 g/l of copper, between about 55 and about 85 ppm of chlorine, between about 20 and about 40 g/l of acid, between about 4 and about 7.5 ml/L of accelerator, between about 1 and 5 ml/L of suppressor, and no leveler. The first chemistry is delivered from the manifold 332 to a first plating cell 102 to enable features disposed on the substrate to be substantially filled with metal. As the first chemistry generally does not completely fill the feature and has an inherently slow deposition rate, the first chemistry may be optimized to enhance the gap fill performance and the defect ratio of the deposited layer. A second chemistry makeup with a different chemistry from the first chemistry may be provided to another plating cell on system 100 via manifold 332, wherein the second chemistry is configured to promote planar bulk deposition of copper on a substrate. The second chemistry may include between about 35 and about 60 g/l of copper, between about 60 and about 80 ppm of chlorine, between about 20 and about 40 g/l of acid, between about 4 and about 7.5 ml/L of accelerator, between about 1 and about 4 ml/L of suppressor, and between about 6 and about 10 ml/L of leveler, for example. The second chemistry is delivered from the manifold 332 to the second process cell to enable an efficient bulk metal deposition process to be performed over the metal deposited during the feature fill and planarization deposition step to fill the remaining portion of the feature. Since the second chemistry generally fills the upper portion of the features, the second chemistry may be optimized to enhance the planarization of the deposited material without substantially impacting substrate throughput. Thus, the two-step, different chemistry deposition process allows for both rapid deposition and good planarity of deposited films to be realized.

Figure 4:
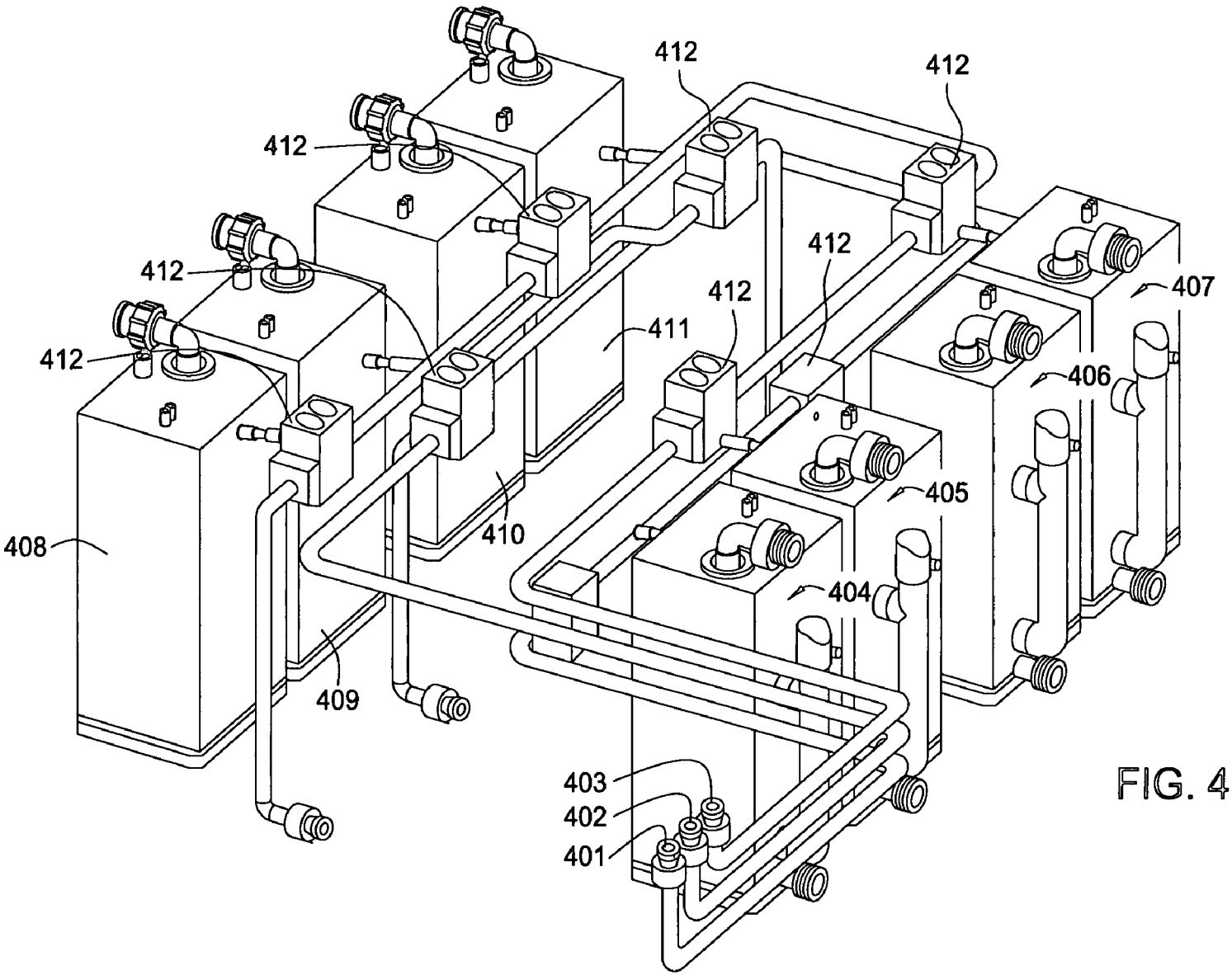
FIG. 4 illustrates an exemplary tank and conduit configuration of the invention.

Plating solution delivery system 300 is in communication with a plurality of fluid conduits that connect the fluid delivery system 300 to fluid storage tanks positioned on board plating system 100. More particularly, the fluid dispensing manifold 332 is generally in communication with a plurality of conduits 401, 402, 403, as illustrated in FIG. 4. Each of the conduits 401, 402, 403 connects to a particular fluid storage tank 404-411, which will be further discussed herein. As such, the fluid delivery system 300 may be controlled to mix and provide a particular catholyte or anolyte solution to any one of the tanks 404-411. The particular anolyte/catholyte solution is provided to manifold 332, which selectively opens actuatable valves to allow the particular solution to flow into one of conduits 401, 402, 403. Assuming, for example, that conduit 401 is configured to supply a particular catholyte to a specific plating cell on platform 100, then the catholyte supplied to conduit 401 is carried by the conduit to a particular plating cell holding tank, such as tank 404, that is configured to supply the specified plating cell with a catholyte. The catholyte solution is delivered to tank 404 and then a valve 412, positioned in conduit 401 immediate tank 404, closes and terminates the flow of solution into tank 404. Then the tank 404 may be used to supply catholyte to a particular plating cell on platform 100 for an electrochemical plating process.

The solution remaining the conduit 401 after supplying solution to the tank 404 may be purged or drained from the conduit prior to another solution being supplied to one or more cells through the particular conduit, so that cross contamination issues may be minimized. The section of the conduit between the valve 421 and the tank 404 is generally configured to purge into the tank, i.e., the conduit may be shaped and sized such that once the solution flow is terminated, the fluid remaining in the conduit is urged to flow into the tank, thus emptying the conduit. The remaining portion of the conduit, e.g., the portion of the conduit behind the valve, is purged through application of a purge gas or liquid to the line. Additionally, as note above with respect to purging of the mixing manifold, the purge liquid may be the VMS solution.

Each of the tanks illustrated in FIG. 4, i.e., tanks 404-411, are generally arranged in pairs. More particularly, tanks 404 and 405 operate as a pair, while tanks 406 and 407, tanks 408 and 409, and tanks 410 and 411 similarly operate as tank pairs. The tank pair generally includes a first tank configured to contain a first solution and a second tank configured to contain a second solution that is different from the first solution. In the exemplary plating system illustrated in FIG. 1, plating location 112 may be outfitted with a plating cell, such as plating cell 200 illustrated in FIG. 2. The first tank 404 may be configured to supply a catholyte solution to cell 200, while the second tank 405 may be configured to provide an anolyte solution to plating cell 200. As noted above, the catholyte solution may be prepared by fluid delivery system 300 and delivered to tank 404 via conduit 401. Similarly, the anolyte solution may be prepared by fluid delivery system 300 and provided to anolyte tank 405 via conduit 403. The respective conduits may be purged after supplying the respective solution to the tanks so that different solutions may be supplied to different tank pairs without contamination.

In similar fashion to the arrangement of tanks 404 and 405, tanks 406 and 407 may be configured to provide plating solutions to a plating cell positioned at processing location 110 on platform 100. Further, tanks 410 and 411 and tanks 408 and 409 may be used to provide plating solutions to plating cells positioned at processing locations 104 and 102, respectively. Each of tank pairs 406-411 may be configured to provide both catholyte solutions and anolyte solutions to their respective plating cells. Alternatively, and the tanks may be configured to provide only catholyte solutions to their associated plating cells, i.e., the tanks may be combined into a single tank configured to supply a single plating solution to one or more cells on the processing platform 100.

Figure 5:
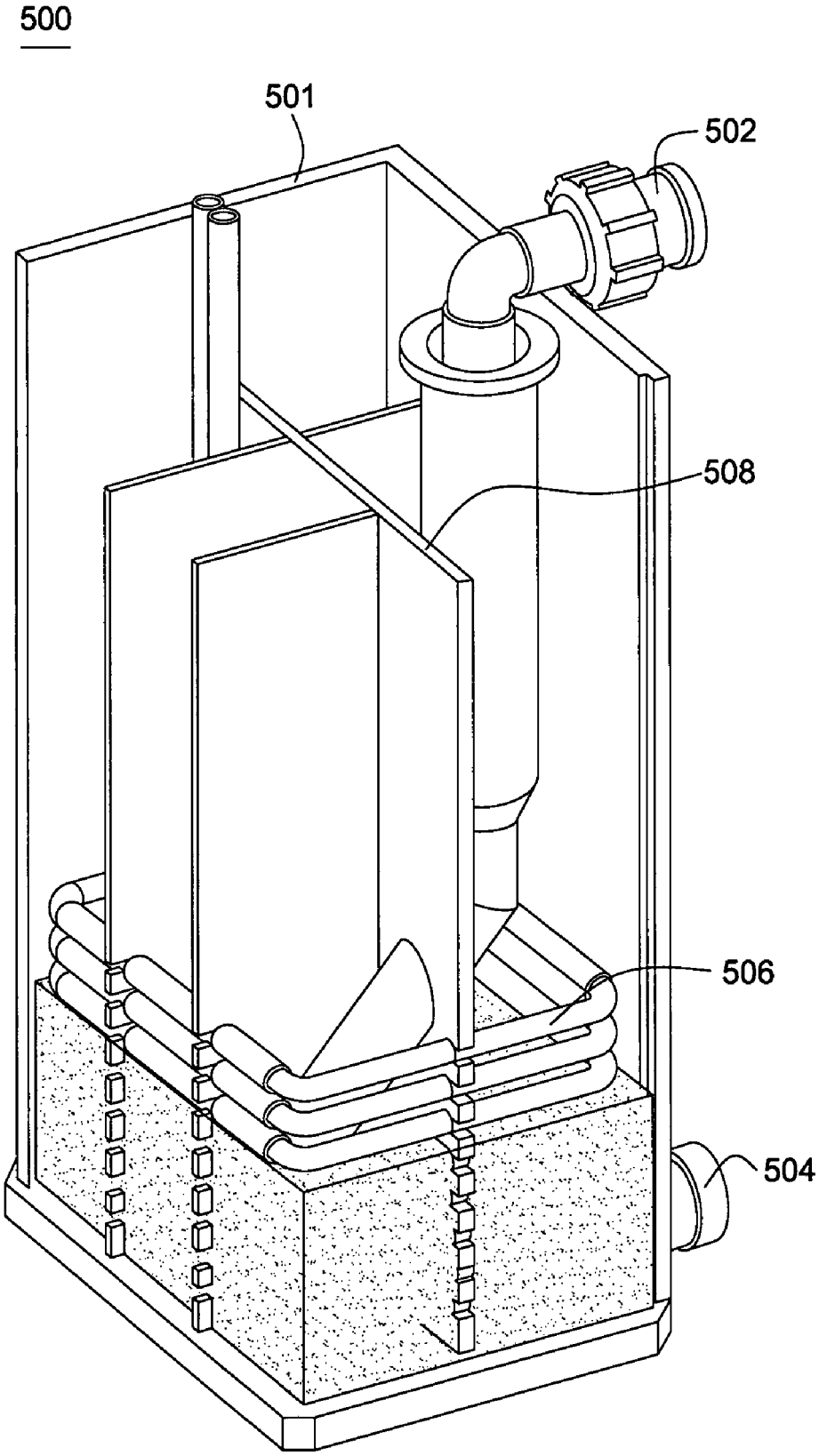
FIG. 5 illustrates a perspective view of the interior components of a fluid tank of the invention.

FIG. 5 illustrates a perspective view of an exemplary tank 500 having two walls of the tank removed to allow for viewing of the interior components of the tank 500. Tank 500 generally includes an enclosed space having upstanding sidewalls 501 that define an interior volume configured to contain a fluid solution therein. A fluid returned assembly 502 extends downward into the tank and terminates near a lower portion of tank 500. The interior volume of tank 500 also includes a plurality of intersecting walls 508 configured to baffle fluid flow within the interior volume of tank 500. A lower portion of tank 500 includes a heat exchanger 506, which generally operates to provide temperature control to the processing fluid contained within tank 500. A pump head assembly 504 extends into the interior volume of tank 500 and terminates adjacent the bottom portion of tank 500, and is generally configured to draw fluid from the interior volume of tank 500 for use in a processing step.

Figure 6B:
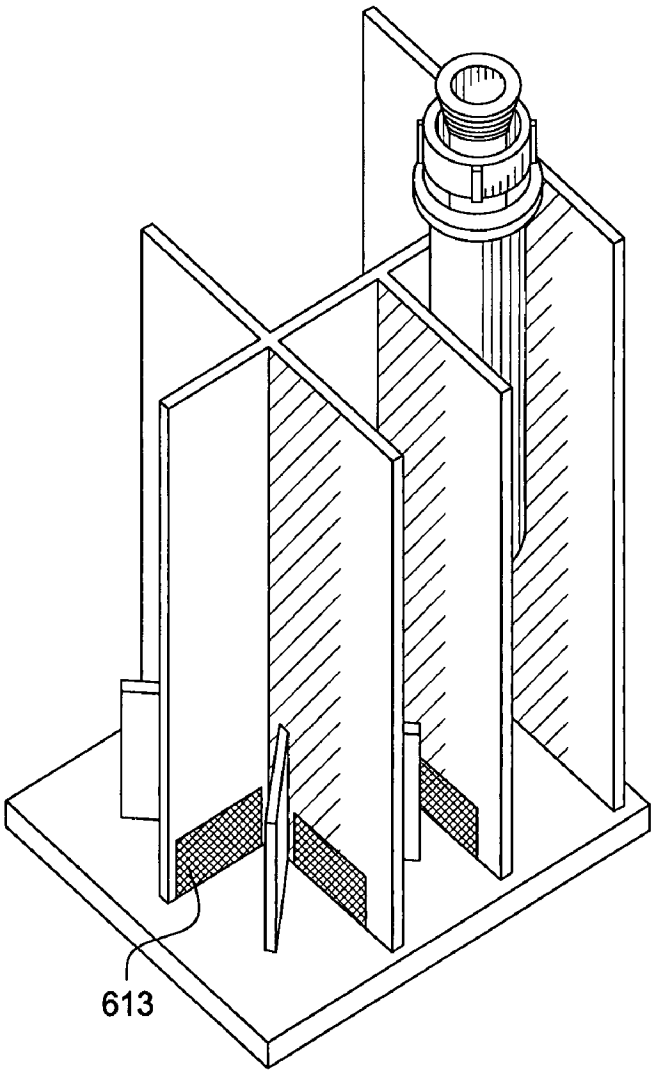
FIG. 6B illustrates a perspective view of exemplary interior wall components of the fluid tank of the invention.
Figure 6A:
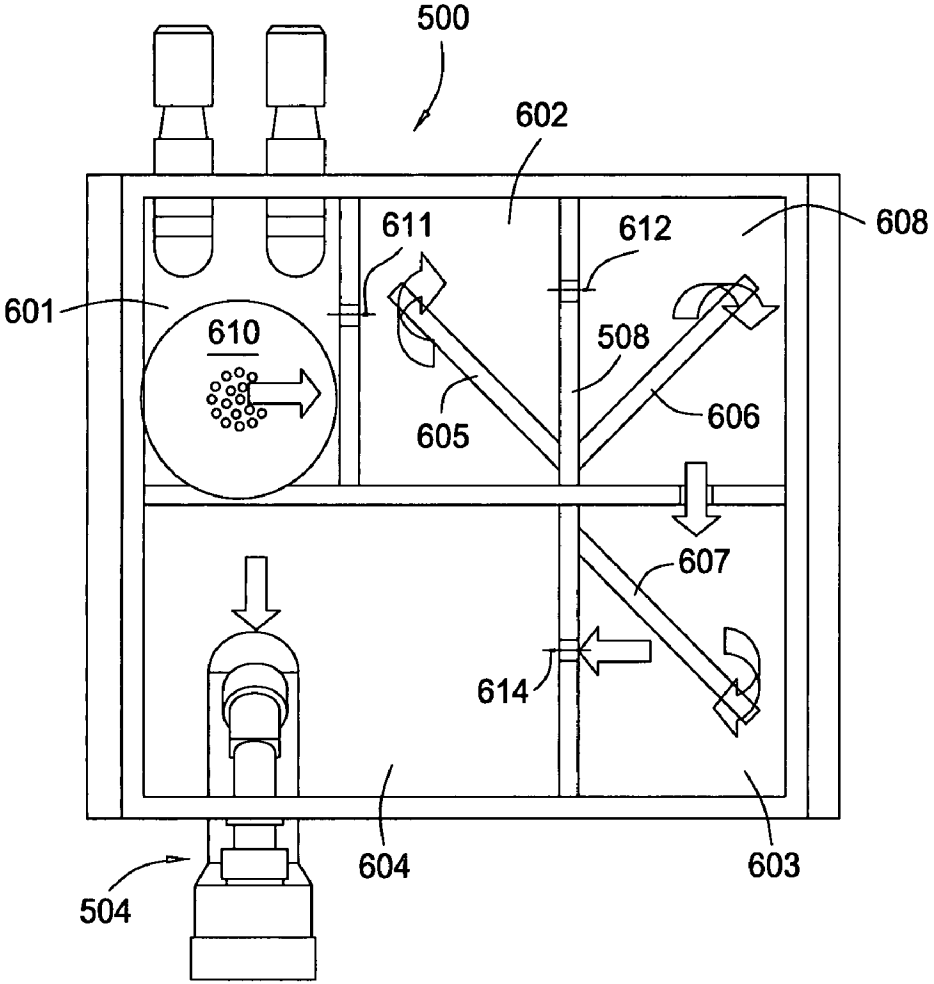
FIG. 6A illustrates a plan view of an exemplary fluid tank of the invention.

FIG. 6A illustrates a plan view of an exemplary fluid tank of the invention. As illustrated in FIG. 5, the fluid tank includes a plurality of upstanding fluid diversion walls 508 positioned in the interior volume of the tank 500. The positioning of the diversion walls 508 generally operates to create a plurality of fluid compartments 601, 602, 603, 604, and 608. Each of the fluid compartments are in communication with an adjoining fluid compartment via a fluid pass-through 613, as illustrated in FIG. 6B.

Figure 7:
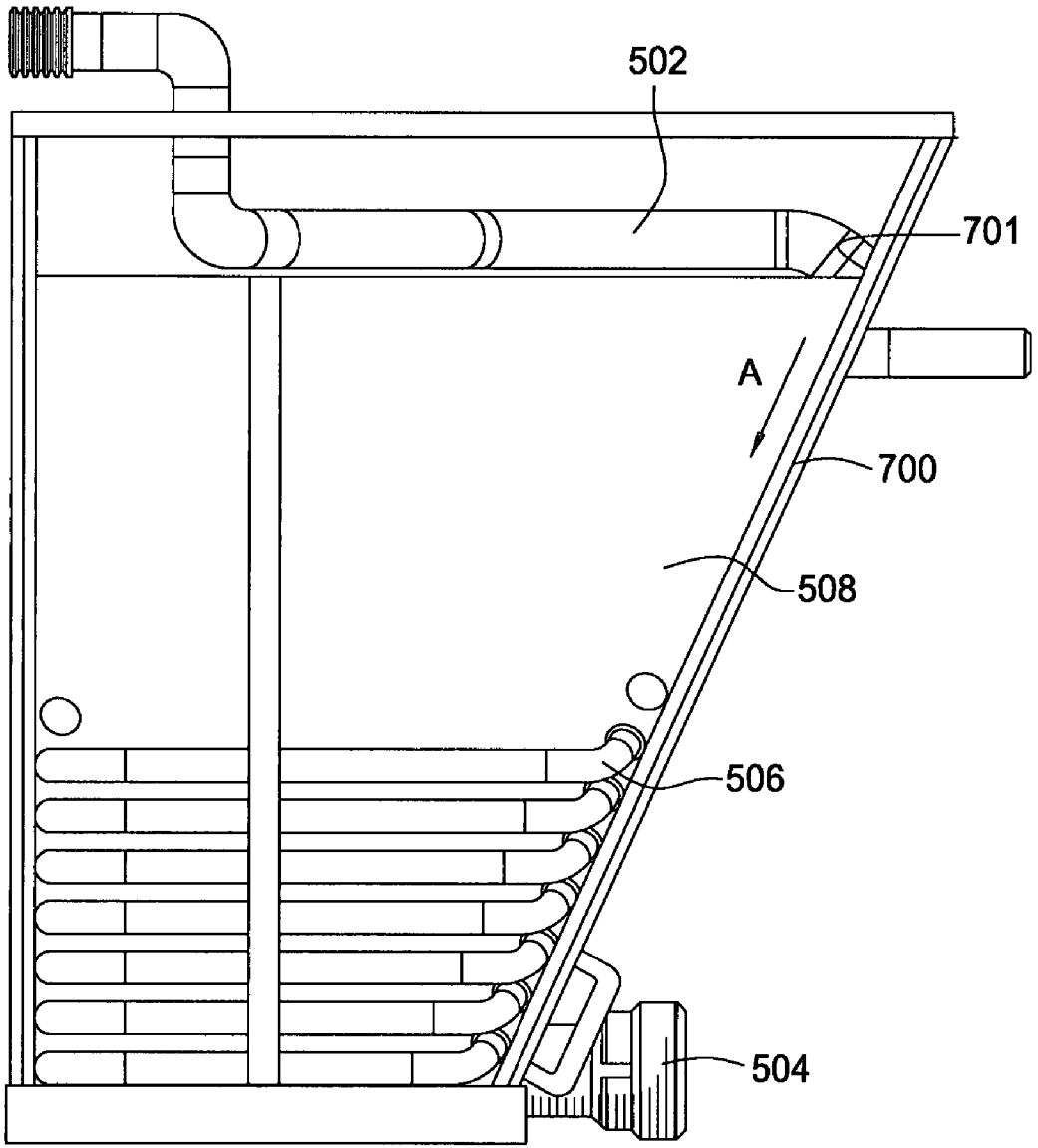
FIG. 7 illustrates a partial perspective and sectional view of an exemplary tank of the invention.

In addition to the interior walls 508, selected compartments of the tanks may include angled fluid diversion walls 605, 606, and 607 positioned therein, as illustrated in FIG. 6A. More particularly, the fluid tanks may include a slanted or angled fluid receiving wall 700 as illustrated in FIG. 7. The angled or slanted wall 700 may be an exterior wall or an interior wall. Regardless, the slanted wall is configured to minimize bubble formation in the solution contained in the tank via minimization of bubbles generated by pouring the liquid solution vertically into the tank. In this embodiment the fluid delivered to the tank is dispensed onto the angled wall 700 by the fluid return line 502, such that the fluid flows onto the wall 700 at location 701 and flows downwardly along the surface of the wall 700 in the direction indicated by arrow "A" into the solution contained in the tank. The flow of the solution down the sloped or slanted wall into the solution minimizes bubbles formed at the interface between solution in the tank and the solution being returned to the tank.

Therefore, in operation, fluid is generally returned to tank 500 via a fluid supply line 610 that terminates in a first fluid compartment 601 (optionally the fluid supply line may terminate onto an angled wall, as described above). The fluid supplied to compartments 601 travels through a first fluid pass-through 611 into a second fluid compartment 602. Once the fluid enters the second fluid compartment 602, the fluid is directed toward an angled fluid diversion wall 605. The fluid travels around the angled fluid diversion wall 605 and travels through a second fluid pass-through 612 into a second fluid compartment 608. In similar fashion to the first fluid compartment, the fluid closed against an angled wall and through another fluid pass-through into a third fluid compartment 603, where the same process is repeated until the fluid passes through a final fluid pass-through 614 into a final fluid compartment 604. Each of the individual angled walls are configured to interact with the fluid flow in a manner that minimizes bubbles in the tank, as will be further discussed herein. Further, the positioning of the pass throughs 611-614 also operates to minimize bubbles in the tanks, as the buoyancy of the bubbles generally prevents the bubbles from traveling through the pass throughs positioned in the lower portion of the respective walls. The pump head 504 generally terminates in the final fluid compartment 604, and therefore, fluid is pumped from tank 500 via the pump head 504 out of the final compartment 604.

As noted above, the positioning of the plurality of upstanding walls 508 and angled fluid diversion walls 605, 606, 607 operates to minimize bubbles in the fluid solution being pumped from tank 500. More particularly, the configuration of tank 500 is designed such that fluid delivered to tank 500 is required to flow against several walls, around several walls, and through several fluid pass-throughs and before the fluid is pumped from tank 500 via pump head 504. In operation, when fluid is caused to flow against him a stationary surface, and bubbles within the solution are prone to adhere to the stationary surface, and thus, the bubbles are removed from the flowing liquid. Similarly, passage of the fluid through a plurality of fluid feed through 601 has been shown to cause bubbles suspended in the fluid solution to be removed therefrom. As such, the tank configuration of the present invention is configured to minimize bubbles in the fluid solution being pumped from tank 500. This is of particular importance to electrochemical plating systems, as bubbles in the fluid solution, i.e., the electrolyte, that is provided to the plating cell have been shown to cause substantial defects in plated substrates.

In another embodiment of the invention, tank 500 is modified to further minimize bubble formation resulting from fluid being delivered to tank 500. More particularly, conventional fluid storage tanks for electrochemical plating systems generally deliver fluid to the storage tank via an aperture positioned in upper portion of the tank. As such, fluid delivered to the tank falls as a result of gravity and is essentially poured into the solution in the tank. This pouring action has been shown to generate bubbles in the plating solution.

Embodiments of the present invention provide for an improved method for delivering fluid to electrochemical plating system storage tank with minimal bubble formation. The method generally includes positioning an angled wall within the first compartment 601 of tank 500, as generally discussed above and illustrated in FIG. 7. The angled wall may attach to one of the upstanding walls surrounding container 601, and the fluid delivered to tank 500 is dispensed directly onto the angled wall. The fluid flows downward on the angled wall into the fluid in the bottom of the tank. In this configuration the fluid does not fall, get poured, or splash into the tank, rather the fluid is dispensed onto the angled wall and is caused to evenly flow into the bulk solution in a sheet like action with minimal bubble formation in the bulk solution.

Each of the tanks of the present invention are configured to have a high aspect ratio, i.e., the ratio of the height of the tank to the sides or cross sectional area of the tank. As such, the tanks generally have small cross sectional areas, i.e., length and width, and have large height dimensions. This provides for optimal pump head depth even when reduced volumes of solution are being used. For example, embodiments of the present invention utilize a tank having an interior volume of approximately 17 liters, wherein the width is about 9 inches, length is about 7.75 inches, and the height is about 19 inches. As such, the aspect ratio would be greater than 1:1 (19:(9+7.75)). Another feature of the invention that maximizes pump head depth is the positioning of the heat exchanger in the lower portion of the tank. This displaces a substantial volume within the lower portion of the tank, and therefore, increases pump head depth.

In operation, embodiments of the invention generally provide a plumbing system for a plating system, wherein the plumbing system is configured to provide multiple chemistries to multiple plating cells positioned on a unitary electrochemical plating platform. More particularly, the plumbing system of the invention is configured to provide, for example, a first plating solution to a first plating cell on an electrochemical plating platform, while providing a second chemistry that is different from the first chemistry to a second plating cell on the electrochemical plating platform. The plumbing system of the invention may be expanded to provide, for example, four different plating chemistries to four different plating cells positioned on a unitary system platform. Further, in plating systems using plating cells configured to utilize both in anolyte and a catholyte, such as plating cell 200 illustrated in FIG. 2, the plumbing system of the present invention is generally configured to provide separate catholyte solutions to each plating cell positioned on the processing platform, while providing in anolyte solution to each plating cell positioned on the processing platform. In similar fashion to previous embodiments, the catholyte solutions may all be different, and further, the anolyte solutions may also be different from each other.

When operating an electrochemical plating platform, such as platform 100 illustrated in FIG. 1, the delivery system 300 may be activated to generate a catholyte solution for plating cells positioned at processing locations 112 and 110. The catholyte solution may contain an appropriate amount of acid, halides, supporting electrolyte, additives, and/or other components generally used in electrochemical plating solutions. The solution may be mixed in fluid delivery system 300, pumped via conduit 350 to manifold 332, and supplied to conduit 401 for delivery to tanks 404 and 406. In this configuration, tanks 404 and 406 are in the fluid communication with a catholyte chamber of plating cell 200 positioned at processing locations 110 and 112. Since plating cell 200 is the type of plating cell requiring both a catholyte and an anolyte, fluid delivery system 300 may also be activated to generate in anolyte for use in the cells. The anolyte may be generated in fluid delivery system 300, transmitted to manifold 332, and delivered to tanks 405 and 407 via fluid conduit 403. Tanks 405 and 407 are generally in fluid communication with an anode or anolyte compartment of plating cell 200 positioned at processing locations 110 and 112.

The particular combination of anolyte and catholyte supplied to tanks 404-407 may be configured to optimize bottom up fill characteristics for semiconductor substrates. More particularly, the additive concentration, i.e., levelers, suppressors, and accelerators, for example, in the catholyte solutions provided to tanks 404 and 406 may be configured to facilitate the initial stages of plating where high aspect ratio features on semiconductor substrates are nearly void of plated material. The process of beginning feature fill on semiconductor substrates is critical to the overall plating process, as is generally difficult to fill high aspect ratio features from the bottom up without obtaining closure of the feature and generating voids in the plated metal. Therefore, the plumbing system of the present invention allows for the feature fill process to be conducted in particular processing locations with specific chemistries designed to facilitate bottom up fill.

Similarly, once the bottom up or feature fill process is completed, substrates are generally put through a secondary plating process wherein the features are bulk filled or overfilled. The bulk filling process is generally conducted at a greater plating rate than the feature fill process, and therefore, generally uses an increased current density. As such, the chemistry used to promote feature fill may not be optimal for promoting bulk fill processes. Therefore, the plumbing system of the invention provides for additional chemistry capability, such that the feature fill processes and the bulk fill processes may be both conducted on the same platform, even though different chemistries are required to optimize each process. More particularly, processing locations 102 and 104 may include plating cells 200 positioned thereon, wherein the plating cells are configured to promote pulp fill plating processes. Although the plating cell used for feature fill may be essentially identical to the plating cell used for bulk fill, the chemistries supplied to the respective cells is generally different. Thus, the plumbing system of the present invention may be configured to provide a separate catholyte and/r anolyte to tanks 408-411, which are generally configured to supply these respective solutions to processing locations 102, 104. Specifically, fluid delivery system 110 may be activated and caused to generate a catholyte solution configured to promote pulp fill plating processes. The catholyte solution may be delivered to manifold 332, which supplies the catholyte solution to fluid conduit 402. Fluid conduit 402 may deliver the bulk fill catholyte solution to tanks 409 and 411. Similarly, fluid delivery system 300 may be used to generate an anolyte solutions for the bulk fill process, and this anolyte solution may be delivered to tanks 408 and 410 via conduit 403.

Once plating solutions delivered to the respective tanks, substrates may be introduced into processing platform 100 and positioned in one of processing locations 110 or 112. Features formed onto the substrate may be filled in a feature fill plating process conducted at processing locations 110 112. Thereafter, the substrates may be transferred to processing locations 102 or 104 4 8 bulk fill process. The process is conducted in processing locations 110 112 may use a separate or different chemistry from the process is conducted at cell locations 102 104. Further still, the chemical solution used at anyone processing locations, i.e. processing locations 112, may be different from any other processing location, i.e. processing locations 110, as the fluid delivery system 110 and the plumbing system of the present invention allows for separate chemistries to be supplied to each individual plating cell on the processing platform 100.

In another embodiment of the invention a degasser may be positioned in one of the fluid conduits of the invention to remove bubbles from the fluid flowing through the conduit. The degasser may, for example, be positioned in one of the conduits that connects the tanks to the plating cells and operate to remove any bubbles from the fluid (plating solution) supplied to the plating cells. Additionally, since a plurality of pumps may be needed to generate fluid flow in the plating system of the invention, filters may be positioned in one or more of the fluid conduits. The filters may be configured to remove any particles generated by the mechanical components of the pumps from the fluid flow prior to the fluid reaching the plating cells.

While the foregoing is directed to embodiments of the present invention, other and further embodiments of the invention may be devised without departing from the basic scope thereof, and the scope thereof is determined by the claims that follow.

What is claimed is:

1. A fluid delivery system for a multiple chemistry electrochemical plating platform, comprising:

a solution mixing system fluidly communicating with a fluid distribution manifold, wherein the solution mixing system comprises:

a fluid metering pump having a plurality of fluid inputs and at least one fluid output in fluid communication with the manifold;

a base solution container in fluid communication with one of the plurality of inputs;

a plurality of additive containers, each of the plurality of additive containers being in fluid communication with at least one of the inputs; and a controller in communication with the fluid metering pump, the controller being configured to operate the metering pump such that the base solution and fluid from the plurality of additive containers is mixed in a predetermined ratio and dispensed from one of the at least one outputs;

a catholyte supply conduit in fluid communication with the manifold and selectively in fluid communication with a plurality of catholyte fluid solution tanks;

an anolyte supply conduit in fluid communication with the manifold and selectively in fluid communication with a plurality of anolyte fluid solution tanks, wherein the plurality of catholyte tanks and the plurality of anolyte tanks are grouped into pairs, wherein each pair comprises one catholyte tank and one anolyte tank, wherein each of the pairs is in fluid communication with an individual plating cell, wherein each of the anolyte and catholyte tanks comprise a fluid baffle system positioned in an interior of the tanks, and wherein the baffle system comprises:

at least two compartments, the at least two compartments being separated by at least one wall;

a fluid feed through positioned in a lower portion of the wall; and at least one angled wall positioned in a fluid flow path within each of the at least two compartments; and a selectively actuated valve positioned adjacent each of the anolyte and catholyte tanks in the supply conduits.

2. A plating solution mixing and delivery system for an electrochemical plating platform, comprising:

a fluid mixing apparatus, comprising:

a fluid metering pump having a plurality of inputs and at least one output:

a base solution container in fluid communication with one of the plurality of inputs;

a plurality of additive containers, each of the plurality of additive containers being in fluid communication with at least one of the inputs; and a controller in communication with the fluid metering pump, the controller being configured to operate the metering pump such that the base solution and fluid from the plurality of additive containers is mixed in predetermined ratios and dispensed from one of the at least one outputs;

a fluid dispensing manifold in fluid communication with the at least one output;

an anolyte conduit in fluid communication with the manifold, the anolyte conduit fluidly communicating with an anolyte storage tank;

a catholyte conduit in fluid communication with the manifold, the catholyte conduit fluidly communicating with a catholyte storage tank, wherein the catholyte storage tank comprises a six sided fluid containing tank having at least one slanted fluid receiving side, wherein the catholyte storage tank comprises a fluid return line positioned to dispense circulated catholyte onto an interior surface of the slanted fluid receiving side, wherein the catholyte tank comprises a baffle system positioned in an interior of the tank wherein the baffle system comprises:

a plurality of baffle walls that cooperatively form a plurality of fluidly isolated compartments; and a plurality of fluid pass throughs positioned on a lower portion of the plurality of baffle walls, the plurality of fluid pass throughs operating to allow fluid to travel from one isolated compartment to an adjacent isolated compartment; and an electrochemical plating cell having an anolyte compartment and a catholyte compartment, the anolyte compartment being in fluid communication with the anolyte storage tank and the catholyte compartment being in fluid communication with the catholyte storage tank.

3. The system of claim 2, wherein each of the isolated compartments includes an angled fluid engaging wall positioned in a fluid path therein.

4. A plating solution mixing and delivery system for an electrochemical plating platform, comprising:

a fluid mixing apparatus, comprising:

a fluid metering pump having a plurality of inputs and at least one output;

a base solution container in fluid communication with one of the plurality of inputs;

a plurality of additive containers, each of the plurality of additive containers being in fluid communication with at least one of the inputs; and a controller in communication with the fluid metering pump, the controller being configured to operate the metering pump such that the base solution and fluid from the plurality of additive containers is mixed in predetermined ratios and dispensed from one of the at least one outputs;

a fluid dispensing manifold in fluid communication with the at least one output;

an anolyte conduit in fluid communication with the manifold, the anolyte conduit fluidly communicating with an anolyte storage tank wherein the anolyte tank comprises a plurality of isolated fluid chambers separated by baffle walls having fluid pass throughs positioned on a lower portion thereof;

a catholyte conduit in fluid communication with the manifold, the catholyte conduit fluidly communicating with a catholyte storage tank; and an electrochemical plating cell having an anolyte compartment and a catholyte compartment, the anolyte compartment being in fluid communication with the anolyte storage tank and the catholyte compartment being in fluid communication with the catholyte storage tank.

5. The system of claim 4, comprising a fluid purge valve positioned adjacent each of the anolyte and catholyte tanks in the respective anolyte and catholyte conduits.

6. The system of claim 4, wherein the fluid purge valve is in communication with the controller and is configured to drain the catholyte conduit and the anolyte conduit once a desired chemistry is delivered to the respective anolyte or catholyte tank.

7. A plating solution mixing and delivery system for a multi-chemistry electrochemical plating system, comprising:

a plating solution mixing assembly positioned onboard the multi-chemistry electrochemical plating system;

at least one catholyte solution tank and at least one anolyte solution tank, each of the anolyte solution tank and the catholyte solution tank being in fluid communication with the plating solution mixing assembly;

a fluid bubble baffle assembly positioned inside the catholyte solution tank, wherein the fluid bubble baffle assembly comprises:

a plurality of upstanding walls that cooperatively form isolated fluid chambers therebetween, the plurality of upstanding walls having a plurality of fluid pass throughs positioned at a lower base of the upstanding walls, the positioning of the fluid pass throughs being configured to generate a serial fluid path through all of the isolated fluid chambers; and a plurality of angled baffle walls positioned in a fluid path of each of the isolated chambers; and a supply line purge valve positioned adjacent each of the catholyte solution tank and the anolyte solution tank in fluid communication with fluid supply return line for the respective tanks, the supply line purge valve being configured to drain fluid from the supply return line after a fluid solution has been delivered to the tank.

8. The system of claim 7, wherein the catholyte solution tank includes a tilted wall configured to receive recirculated catholyte solution thereon and flow the catholyte solution downward towards the bottom of the catholyte solution tank while maintaining the flowing catholyte solution on a tilted surface of the wall.

9. The system of claim 7, wherein the plating solution mixing assembly comprises:

a fluid metering pump having a plurality inputs and at least one output;

a virgin plating solution source in fluid communication with one of the plurality of inputs;

a plurality of additive sources in fluid communication with individual inputs of the fluid metering pump; and a metering pump controller configured to operate the metering pump such that the virgin plating solution is mixed with the additive sources in a predetermined ratio and dispensed from the output of the metering pump to the catholyte tank or the anolyte tank.

* * * * *

UNITED STATES PATENT AND TRADEMARK OFFICE

CERTIFICATE OF CORRECTION

PATENT NO. : 7,473,339 B2
APPLICATION NO. : 10/826489
DATED : January 6, 2009
INVENTOR(S) : D'Ambra et al.

It is certified that error appears in the above-identified patent and that said Letters Patent is hereby corrected as shown below:

Column 2, Line 29, please delete "thy" and insert --the-- therefor;

Column 8, Line 30, please delete "gas";

Column 8, Line 35, please delete "gas";

Column 9, Line 41, please delete "421" and insert --412-- therefor;

Column 9, Line 48, please delete "note" and insert --noted-- therefor.

Signed and Sealed this

Twenty-first Day of April, 2009

JOHN DOLL
*Acting Director of the United States Patent and Trademark Office*